US008746511B2

(12) United States Patent
Rockstad et al.

(10) Patent No.: US 8,746,511 B2
(45) Date of Patent: Jun. 10, 2014

(54) SELF-SEALING DISPENSER INSERT AND METHOD FOR ASSEMBLING THE SAME

(75) Inventors: Ross E. Rockstad, Maple Valley, WA (US); Stephen F. Thompson, Black Diamond, WA (US)

(73) Assignee: The Boeing Company, Chicago, IL (US)

( * ) Notice: Subject to any disclaimer, the term of this patent is extended or adjusted under 35 U.S.C. 154(b) by 83 days.

(21) Appl. No.: 13/253,204

(22) Filed: Oct. 5, 2011

(65) Prior Publication Data

US 2013/0087574 A1 Apr. 11, 2013

(51) Int. Cl.

| | |
|---|---|
| ***B65D 37/00*** | (2006.01) |
| ***B05B 11/04*** | (2006.01) |
| ***B05B 11/00*** | (2006.01) |
| ***B65D 51/16*** | (2006.01) |

(52) U.S. Cl.

CPC ..... *B05B 11/047* (2013.01); *B05B 11/007* (2013.01); *B05B 11/0072* (2013.01); *B65D 51/1644* (2013.01); *Y10S 215/902* (2013.01)

USPC ..... 222/213; 222/1; 222/482; 222/494; 215/902

(58) Field of Classification Search

CPC ..... B05B 11/0018; B05B 11/007; B05B 11/0072; B05B 11/047; B65D 51/1644; Y10S 215/902

USPC ..... 222/17, 206, 212, 213, 481, 1, 482, 222/484, 494

See application file for complete search history.

(56) References Cited

U.S. PATENT DOCUMENTS

| | | | | |
|---|---|---|---|---|
| 1,735,784 | A | 11/1929 | Olson | |
| 3,474,936 | A | 10/1969 | McDonnell | |
| 4,073,294 | A | 2/1978 | Stanley et al. | |
| 4,122,979 | A * | 10/1978 | Laauwe | 222/633 |
| 4,179,051 | A | 12/1979 | Thomas | |
| 4,286,735 | A | 9/1981 | Sneider | |
| 4,340,157 | A | 7/1982 | Darner | |
| 4,420,100 | A * | 12/1983 | Mueller | 222/205 |
| 4,557,401 | A | 12/1985 | Hodge | |

(Continued)

FOREIGN PATENT DOCUMENTS

| | | |
|---|---|---|
| FR | 601464 | 3/1926 |
| WO | 2011075589 A1 | 6/2011 |

OTHER PUBLICATIONS

Extended European Search Report of Application No. 12186136; Jan. 25, 2013; 5 pages.

*Primary Examiner* — J. Casimer Jacyna

(74) *Attorney, Agent, or Firm* — Armstrong Teasdale LLP

(57) ABSTRACT

A fluid dispenser is described that includes a dispenser, a cap, and an insert. The dispenser is flexible and includes a body portion and a cylindrical mouth portion extending from the body portion. The mouth portion has an opening defining a lip. The cap is operable to engage the mouth portion of the dispenser, said cap has an aperture therethrough operable to dispense a fluid stored within the dispenser. The insert is sized for placement within the opening, between the mouth portion and the cap and includes a substantially solid plug having a first and a second axial hole therethrough, a first reed valve operably attached to the plug to close the first axial hole from an outside of the dispenser, and a second reed valve operably attached to the plug to close the second axial hole from an inside of the dispenser.

15 Claims, 5 Drawing Sheets

(56) References Cited

U.S. PATENT DOCUMENTS

| | | | | | |
|---|---|---|---|---|---|
| 4,711,378 | A | * | 12/1987 | Anderson | 222/499 |
| 4,828,149 | A | * | 5/1989 | Hester | 222/207 |
| 4,964,380 | A | * | 10/1990 | Kusche | 123/184.23 |
| 5,079,013 | A | | 1/1992 | Belanger | |
| 5,310,112 | A | * | 5/1994 | Meshberg | 222/482 |
| 5,366,115 | A | | 11/1994 | Kersten et al. | |
| 5,655,686 | A | | 8/1997 | Jermyn | |
| 5,873,478 | A | * | 2/1999 | Sullivan et al. | 215/389 |
| 5,890,620 | A | | 4/1999 | Belcastro | |
| 5,919,360 | A | * | 7/1999 | Contaxis et al. | 210/198.1 |
| 6,000,481 | A | * | 12/1999 | Heller et al. | 175/20 |
| 6,264,452 | B1 | * | 7/2001 | Sun et al. | 418/270 |
| 6,561,371 | B2 | | 5/2003 | Sciarini | |
| 7,503,317 | B2 | * | 3/2009 | Nelson et al. | 123/572 |
| 7,828,176 | B2 | * | 11/2010 | Harper | 222/207 |
| 2002/0112768 | A1 | * | 8/2002 | Okuyama et al. | 137/856 |
| 2004/0206776 | A1 | * | 10/2004 | Awbrey et al. | 222/105 |
| 2006/0102113 | A1 | * | 5/2006 | Tiller et al. | 123/65 V |
| 2006/0219300 | A1 | * | 10/2006 | Tassinari et al. | 137/512.15 |
| 2008/0202631 | A1 | * | 8/2008 | Loewenthal et al. | 141/26 |

* cited by examiner

SELF-SEALING DISPENSER INSERT AND METHOD FOR ASSEMBLING THE SAME

BACKGROUND

The field of the disclosure relates generally to caps for fluid dispensers, and more specifically to self-sealing caps for chemical dispensers.

Some known fluid storage dispensers include a flexible body that may discharge a liquid contained therein through an opening in the dispenser when a squeezing pressure, for example from an operator's hand is applied. Some known dispensers may include a sealing means that provides a subsequent sealing action after the pressure is removed, but such dispensers require a two-handed arrangement with these dispensers wherein the closing action must be done by the operator's second hand. Some other known dispensers simply require that each hand manipulate one of two parts to facilitate closing the fluid dispenser.

A known housing for a control valve used on a squeeze type fluid dispensing container includes a first check valve fixedly coupled inside a housing. When the first check valve is opened, fluid flow is permitted through an opening and out of a tube in the housing. A second such check valve is fixedly coupled inside the first check valve, and when opened, facilitates channeling the fluid flow from the tube into the housing, then through an opening in the housing and back into the dispenser.

Some other known fluid dispensers provide a dual-valve system. Such dual valve assemblies respond to differences in pressure, and cooperate to dispense the fluid from the dispenser, or seal the openings thereof during non-use. The cap may include a valve positioned within the dispenser outlet which is cleaned of material at the end of the dispensing period by the action of the dispenser mechanism herein. However, such dual valve assemblies are not directly exposed to the atmosphere, and fail to allow ambient air into the dispenser to normalize the squeezable dispenser, while maintaining the liquid, and any gaseous product associated with the liquid, within the dispenser during periods of non-use.

SUMMARY

In one aspect, a fluid dispenser is provided. The fluid dispenser includes a dispenser made from a flexible material and having a body portion and a cylindrical mouth portion extending from the body portion, the mouth portion defining an opening further defining a lip extending about the opening, a cap operable to engage the mouth portion of the dispenser, the cap comprising an aperture therethrough operable to dispense a fluid stored within the dispenser, and a cylindrical insert sized for placement within the opening between the mouth portion and the cap. The cylindrical insert includes a substantially solid plug having a first axial hole therethrough and a second axial hole therethrough, a first reed valve operably attached to the plug to close the first axial hole from an outside of the dispenser, and a second reed valve operably attached to the plug to close the second axial hole from an inside of the dispenser.

In another aspect, an insert sized for placement within an opening of a dispenser is provided. The insert includes a substantially solid plug having a first surface, a second surface, and first and second axial holes extending from the first surface to the second surface, a first reed valve operably attached to the first surface of the plug to close the first axial hole, and a second reed valve operably attached to the second surface of the plug to close the second axial hole.

In yet another embodiment, a method dispensing a fluid from a flexible dispenser is provided. The method includes applying a positive pressure to the dispenser to force the fluid through a first axial hole formed in a plug placed in a opening of the dispenser, the pressure causing a first reed valve mounted on a side of the plug opposite the fluid storage to move away from the first axial hole to allow the fluid to pass through, the positive pressure further causing a second reed valve on a side of the plug where the fluid is contained to maintain placement to substantially seal a second axial hole formed in the plug, releasing the positive pressure to allow the first reed valve to return to a position that substantially seals the first axial hole and allows the second reed valve to open thereby allowing air to enter the dispenser through the second axial hole until a difference in pressure between an interior and an exterior of the dispenser is reduced to substantially zero, and allowing the second reed valve to substantially reseal the second axial hole.

The features, functions, and advantages can be achieved independently in various embodiments of the present disclosure or may be combined in yet other embodiments in which further details can be seen with reference to the following description and drawings.

DETAILED DESCRIPTION

The following detailed description illustrates the disclosure by way of example and not by way of limitation. The description should enable one skilled in the art to make and use the system described herein, describes several embodiments, adaptations, variations, alternatives, and uses of the disclosure, including what is presently believed to be the best mode of carrying out the disclosure. The disclosure is described as applied to exemplary embodiments, namely, a self-sealing cap for a fluid dispenser and methods of fabricating such caps. However, it is contemplated that this disclosure has general application to any fluid container in industrial, commercial, and residential applications.

Figure 1:
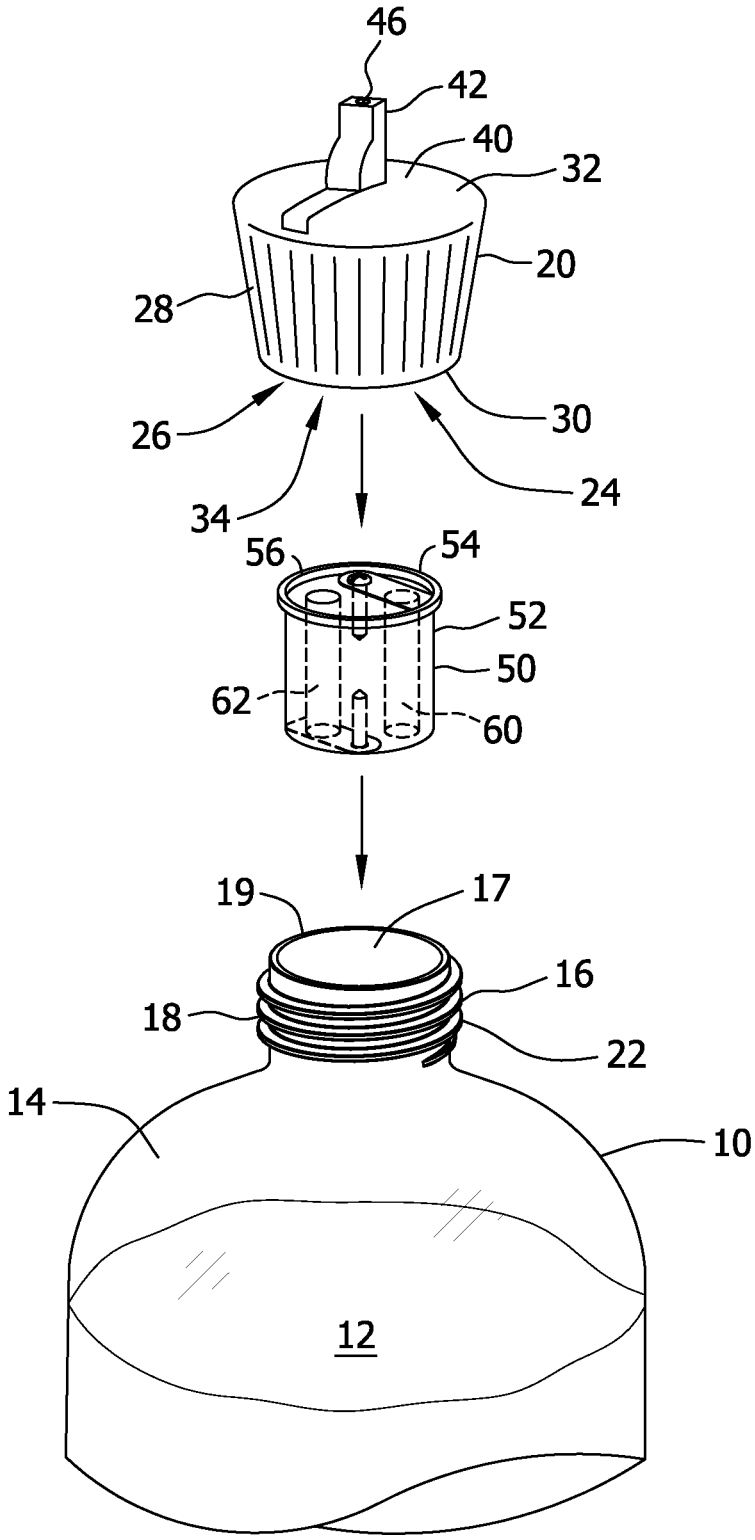
FIG. 1 is schematic illustration of a dispenser and a cap used for storing a fluid therein, a self-sealing dispenser insert disposed between the dispenser and the cap.

FIG. 1 is schematic illustration of an exemplary dispenser 10 used for storing an amount of fluid 12 therein. Dispenser 10 includes a body portion 14 for use in containing and storing fluid 12. In the exemplary embodiment, dispenser 10 is fabricated from a flexible material, such as, but not limited to a polymer or plastic. A mouth portion 16 extends from body portion 14 and includes an orifice 17 that is sized and oriented to enable fluid 12 to be introduced into or out of dispenser 10. Mouth portion 16 includes an outer surface 18 configured to be coupled to a cap 20. Orifice 17 defines a lip 19 at an end of the mouth portion. In the exemplary embodiment, outer surface 18 includes a plurality of threads 22 that are sized and oriented to threadably couple with a plurality of corresponding threads 24 disposed on cap 20. Alternatively, cap 20 may be coupled to mouth portion 16 over outer surface 18 using any coupling method such as, but not limited to, friction fitting, a tab and groove combination, and/or with any coupling configuration that enables dispenser 10 to function as described herein.

In the exemplary embodiment, cap 20 includes an inner surface 26 and an outer surface 28. Cap 20 includes a substantially cylindrical cross-section that includes a first end 30 and a second end 32. First end 30 of cap 20 includes an opening 34 that is sized and oriented to receive mouth portion 16 therein. Cap 20 includes a substantially flat top portion 40 that extends across second end 32 of cap 20. In the exemplary embodiment, cap assembly 20 includes a tip 42 rotatable with respect to and extending from flat top portion 40 of cap 20, and includes an aperture 46 therethrough operable to dispense fluid 12 stored within dispenser 10. In one orientation tip 42 is operable for dispensing of fluid 12, and in another orientation (not shown) tip 42 is not operable for dispensing of fluid 12 as is well known. Alternatively, cap 20 may not include tip 42, but may simply include an aperture (not shown) therethrough that is sized and oriented to enable dispensing fluid 12 from dispenser 10 as described in more detail herein.

A plug portion of a self sealing dispenser insert 50 is shown disposed between cap 20 and dispenser 10 in FIG. 1. Self sealing dispenser insert 50, in the illustrated embodiment is a cylindrical insert sized for placement within the orifice 17, or opening, substantially between the mouth portion 16 and the cap 20. As inferred above, self sealing dispenser insert 50 is a substantially solid plug 52 that includes a protrusion 54 about a perimeter at a top 56 thereof. The protrusion 54 is operable for engaging the lip 19 of the mouth portion 16, essentially forming a washer between the dispenser 10 and the cap 20. In embodiments, the plug 52 is fabricated from a plastic.

Figure 2:
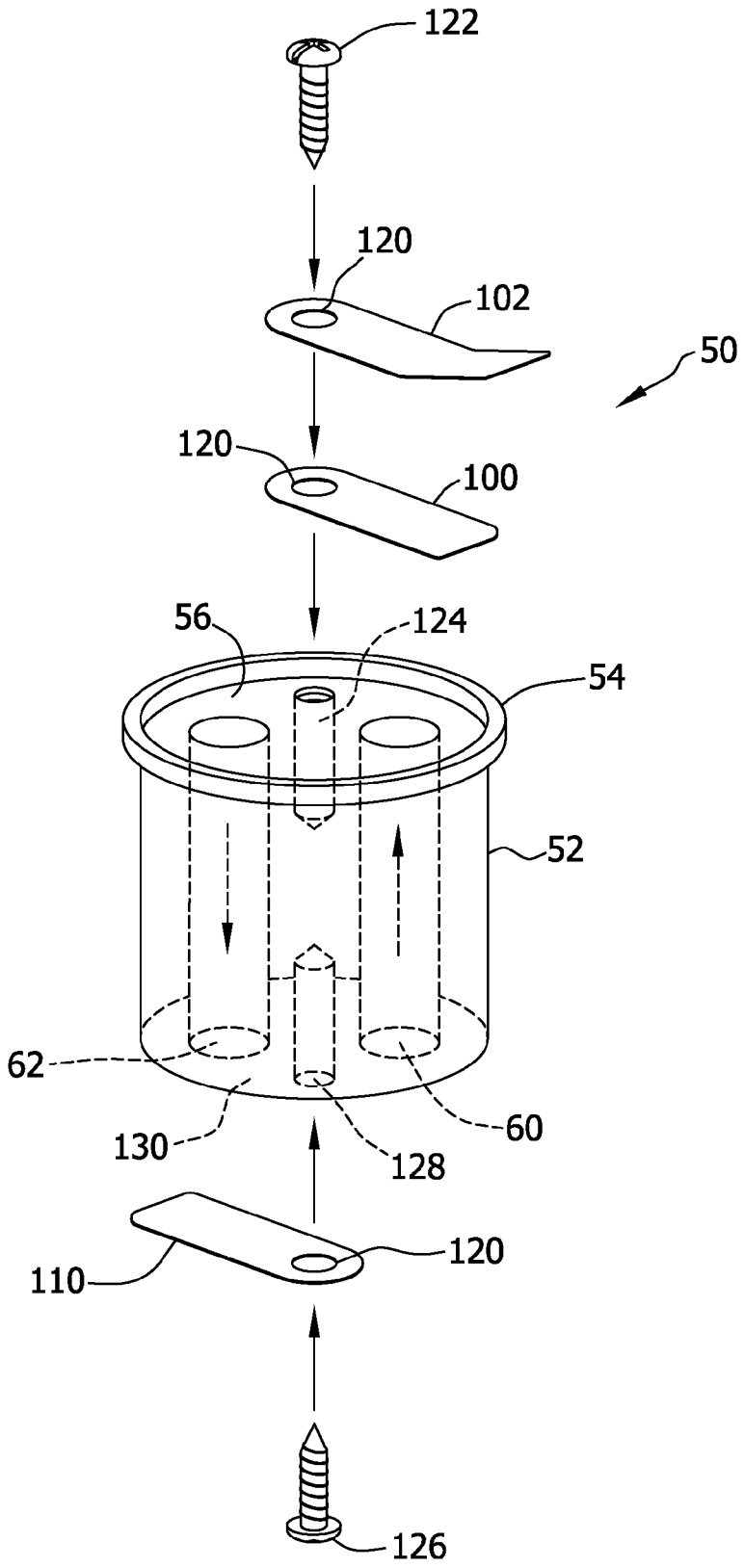
FIG. 2 is a detailed illustration of the self-sealing dispenser insert shown in FIG. 1.

Referring to the detailed illustration of FIG. 2, self sealing dispenser insert 50 includes a first axial hole 60 and a second axial hole 62 formed through the plug 52. A first reed valve 100 is operably attached to the plug 52 positioned to close and/or substantially seal the first axial hole 60 from an outside of the dispenser 10. The first reed valve 100 applies a biasing force for closing the first axial hole 60 in the absence of an externally applied pressure. A reed retainer 102 is also operably attached to the plug 52. Reed retainer 102 is operable to place a further positive pressure onto the first reed valve 100 with respect to the first axial hole 60, helping to maintain the seal between first reed valve 100 and plug 52 when the dispenser insert 50 is operatively deployed. A second reed valve 110 is operably attached to the plug 52 positioned to close and/or substantially seal the second axial hole 62 from an inside of the dispenser 10 when the dispenser insert 50 is operatively deployed. The second reed valve 110 applies a biasing force for closing the second axial hole 62 in the absence of an externally applied pressure.

As shown in FIG. 2, the first reed valve 100, the reed retainer 102, and the second reed valve 110 are fabricated with holes 120 therein. A screw 122 is utilized to attach the first reed valve 100 and the reed retainer 102 to the plug 52 by passing through the holes 120, with the screw 122 eventually engaging a bore 124 in the top 56 of the plug 52. As shown, top 56 includes a recessed area which allows the first reed valve 100 to operate without engaging the cap 20.

A screw 126 is utilized to attach the second reed valve 110 to the plug 52 by passing through the hole 120, with the screw 126 engaging a bore 128 in a bottom 130 of the plug 52. Screw 122 operates to maintain an orientation of the first reed valve 100 and the reed retainer 102 with respect to the first axial hole 60. Screw 126 operates to maintain an orientation of the second reed valve 110 with respect to the second axial hole 62.

In embodiments, the first reed valve 100 and the second reed valve 110 are fabricated utilizing steel. In a specific embodiment, for a dispenser that is approximately hand sized (e.g., three inches in diameter and about six inches tall), the first reed valve 100 and the second reed valve 110 are fabricated from a steel of about 0.003 inch in thickness. In an embodiment, the reed retainer 102 is made from aluminum.

As is understood from a review of FIGS. 1 and 2, first reed valve 100 is operable to deflect away from the plug 52 when a positive pressure is placed on dispenser 10 to allow fluid 12 to pass from dispenser 10, through the first axial hole 60 and on through the aperture 46 of the tip 42. The second reed valve 110 is operable to deflect away from the plug 52 when a negative pressure is placed on the dispenser 10 to allow a fluid (e.g., air) to pass into the dispenser 10, through the aperture 46 of the tip 42 and the second axial hole 62. More specifically, the first reed valve 100 is operable to deflect away from the top 56 surface when a positive pressure, originating proximate the bottom 130, is applied through the first axial hole 60 and the second reed valve 110 is operable to deflect away from the bottom 130 surface when a positive pressure, originating proximate the top 56 surface, is applied through the second axial hole 62. In embodiments, depending on the flexibility of second reed valve 110, a reed retainer similar to reed retainer 102 may be incorporated into the embodiment of FIG. 2.

Figure 3:
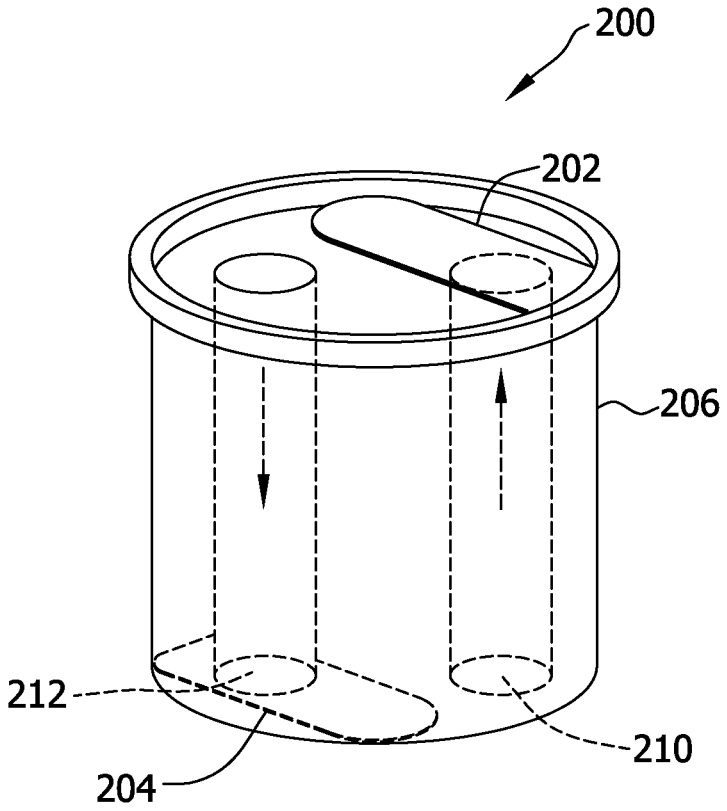
FIG. 3 is a detailed illustration of an alternative embodiment of a self-sealing dispenser insert that can be used with the dispenser and cap of FIG. 1.

FIG. 3 illustrates an alternative embodiment of a dispenser insert 200 in which a first reed valve 202 and a second reed valve 204 are integrally formed as part of a plug 206. Specifically, first reed valve 202, second reed valve 204 and plug 206 are formed as a single molded piece. First axial hole 210 and second axial hole 212 allow first reed valve 202 and second reed valve 204 to operate in the manner described above with respect to the embodiment of FIG. 2. Depending on the flexibility of reed valves 202 and 204 one or more reed retainers similar to reed retainer 102 may be incorporated into the embodiment of FIG. 3.

Figure 4:
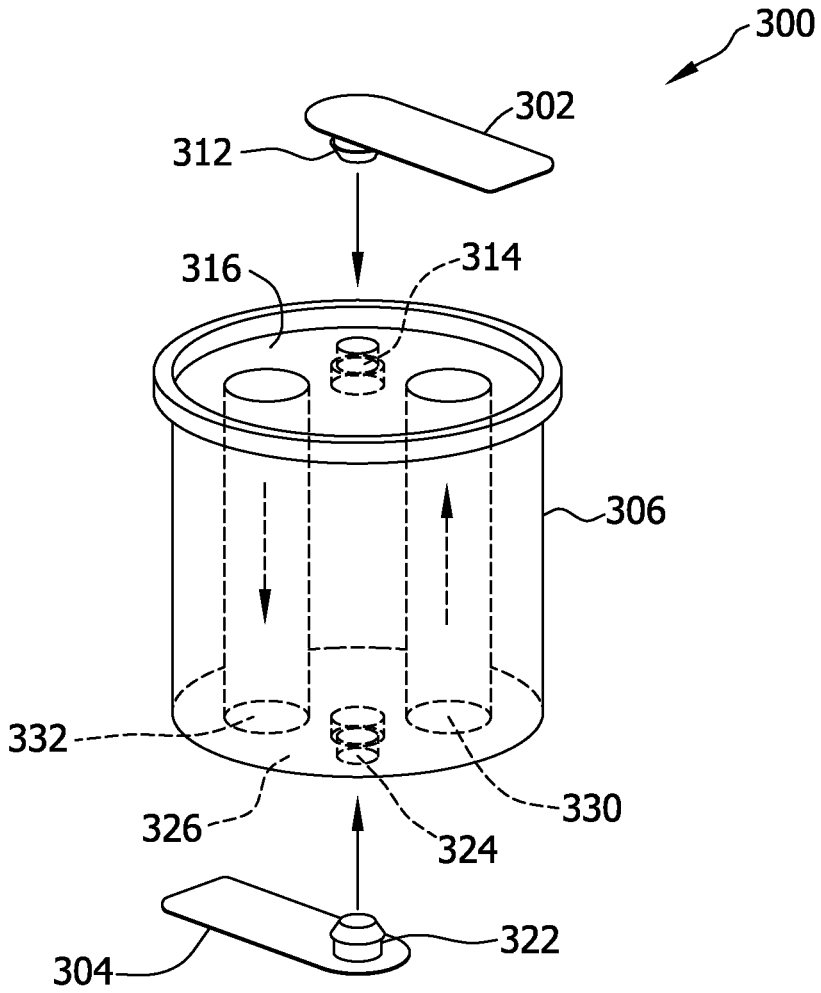
FIG. 4 is a detailed illustration of another alternative embodiment of a self-sealing dispenser insert that can be used with the dispenser and cap of FIG. 1.

FIG. 4 illustrates another alternative embodiment of a dispenser insert 300 in which a first reed valve 302 and a second reed valve 304 are attached to plug 306 utilizing a snap fit mechanism. Specifically, first reed valve 302 incorporates a snap fit pin 312 which is inserted into a corresponding bore 314 or mating feature accessible from the top 316 of plug 306. The second reed valve 304 incorporates a snap fit pin 322 which is inserted into a corresponding bore 324 or mating feature accessible from the bottom 326 of plug 306. First axial hole 330 and second axial hole 332 allow first reed valve 302 and second reed valve 304 to operate in the manner described above with respect to the embodiment of FIG. 2. Depending on the flexibility of reed valves 302 and 304 one or more reed retainers similar to reed retainer 102 may be incorporated into the embodiment of FIG. 4.

Figure 5:
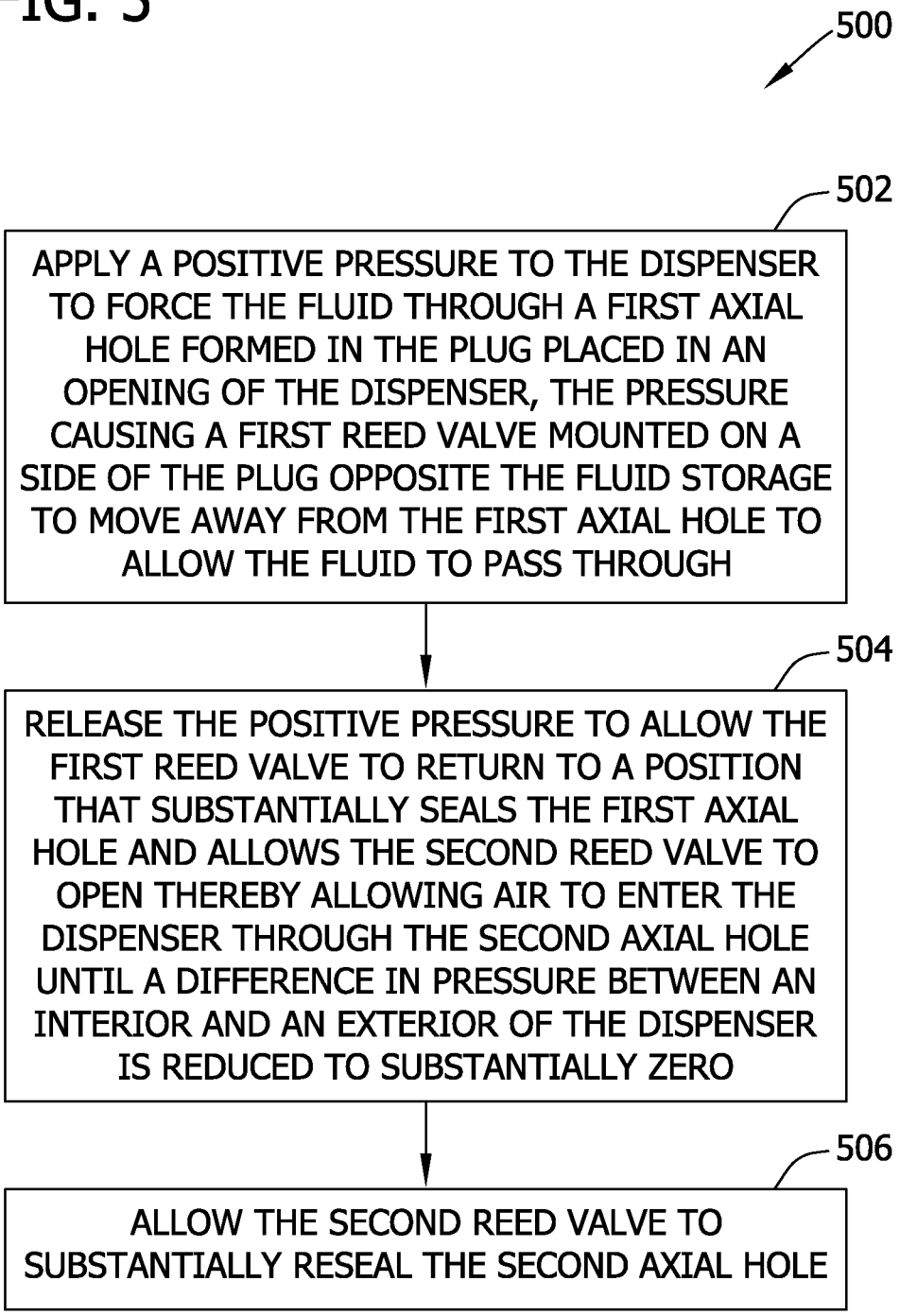
FIG. 5 is a flowchart of a method for dispensing a fluid from a dispenser such as shown in FIG. 1.

FIG. 5 is a flowchart 500 that illustrates a method for dispensing a fluid from a flexible dispenser. The method includes applying 502 a positive pressure to the dispenser 10 to force the fluid 12 through the first axial hole 60 formed in the plug 52 placed in an opening 17 of the dispenser 10, the pressure causing first reed valve 100 mounted on a side of the plug 52 opposite the fluid storage (e.g., on the top 56) to move away from the first axial hole 60 to allow the fluid 12 to pass through, the positive pressure further causing the second reed valve 110 on a bottom 130 of the plug 52, where the fluid 12 is contained, to maintain placement to substantially seal the second axial hole 62 formed in the plug 52.

The method continues by releasing 504 the positive pressure to allow the first reed valve 100 to return to a position that substantially seals the first axial hole 60 and allows the second reed valve 110 to open thereby allowing air to enter the dispenser 10 through the second axial hole 62 until a difference in pressure between an interior and an exterior of the dispenser 10 is reduced to substantially zero. When the difference in pressure is approximately zero, the second reed valve 110 is allowed 506 to substantially reseal the second axial hole 62. Other embodiments of the method include utilizing 504 a reed retainer 102 to place a positive pressure onto the first reed valve 100 with respect to the first axial hole 60.

Exemplary embodiments of an insert sized for placement within an opening of a dispenser are described in detail above. The above-described dispenser insert facilitates providing a substantially sealed chemical dispenser that would normally emit chemical vapors into the surrounding atmosphere when not in use. More specifically, the dispenser cap insert described herein helps to ensure safe environmental conditions in areas where chemicals are stored and facilitates maintaining an area surround the dispenser that is free from harmful gases that may be emitted from the stored chemicals by enabling the dispenser to use atmospheric pressure to seal the dispenser when not in use. Also, the systems described herein will prevent leaking of should chemicals such the dispenser become overturned.

Although the foregoing description contains many specifics, these should not be construed as limiting the scope of the present disclosure, but merely as providing illustrations of some of the presently preferred embodiments. Similarly, other embodiments may be devised which do not depart from the spirit or scope of the present disclosure. Features from different embodiments may be employed in combination. The scope is therefore indicated and limited only by the appended claims and their legal equivalents, rather than by the foregoing description. All additions, deletions and modifications to the embodiments disclosed herein which fall within the meaning and scope of the claims are to be embraced thereby.

Although the assemblies and methods described herein are described in the context of using a dispenser sealing insert with flexible chemical dispenser bottles, it is understood that the apparatus and methods are not limited to chemical storage devices. Likewise, the system components illustrated are not limited to the specific embodiments described herein, but rather, system components can be utilized independently and separately from other components described herein.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

This written description uses examples to disclose various embodiments, including the best mode, and also to enable any person skilled in the art to practice the embodiments contained herein, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fluid dispenser comprising:

a dispenser comprising a flexible material, said dispenser comprising a body portion and a cylindrical mouth portion extending from said body portion, said mouth portion comprising an opening defining a lip extending about said opening;

a cap operable to engage said mouth portion of said dispenser, said cap comprising an aperture therethrough operable to dispense a fluid stored within said dispenser; and a cylindrical insert sized for placement within said opening between said mouth portion and said cap, said cylindrical insert comprising:

a substantially solid plug comprising a first axial hole extending therethrough, a second axial hole extending therethrough, and a protrusion extending about a perimeter of said plug to engage said mouth portion lip at a distal end of said mouth portion that is furthest from said body portion;

a first reed valve operably attached to said plug to close said first axial hole from an outside of said dispenser;

a second reed valve operably attached to said plug to close said second axial hole from an inside of said dispenser;

a reed retainer operable to place a positive pressure onto said first reed valve with respect to said first axial hole; and a fastener attaching said first reed valve and said reed retainer to said plug, said fastener extending through a first aperture formed in said first reed valve and a second aperture formed in said reed retainer.

2. The fluid dispenser of claim 1 wherein said reed retainer comprises aluminum.

3. The fluid dispenser of claim 1, wherein said fastener comprises a threaded fastener, said threaded fastener operable to threadably engage said plug to maintain an orientation of said first reed valve and said reed retainer.

4. The fluid dispenser of claim 1 wherein said first reed valve and said second reed valve comprise steel.

5. The fluid dispenser of claim 1 wherein said first reed valve is operable to deflect away from said plug when a positive pressure is placed on said dispenser to allow a fluid to pass from said dispenser, through said first axial hole, and said aperture of said cap.

6. The fluid dispenser of claim 1 wherein said second reed valve is operable to deflect away from said plug when a negative pressure is placed on said dispenser to allow a fluid to pass into said dispenser, through said aperture of said cap and said second axial hole.

7. The fluid dispenser of claim 1 wherein said substantially solid plug comprises a plastic.

8. The fluid dispenser of claim 1 wherein said dispenser is approximately hand sized, and wherein said first reed valve and said second reed valve comprise a steel of about 0.003 inch in thickness.

9. The fluid dispenser of claim 1 wherein said protrusion forms a washer between said dispenser and said cap.

10. The fluid dispenser of claim 1 wherein said substantially solid plug comprises a recessed area, said first reed valve operably attached to said recessed area.

11. The fluid dispenser of claim 1 wherein said first reed valve comprises a biasing force for closing said first axial hole and said second reed valve comprises a biasing force for closing said second axial hole.

12. An insert sized for placement within an opening of a dispenser defined by a lip, said insert having a cylindrical shape and comprising:

a substantially solid plug comprising a first surface, a second surface, a first axial hole extending from said first surface to said second surface, a second axial hole extending from said first surface to said second surface, and a protrusion extending about a perimeter of said plug and configured to engage the lip of the dispenser at a distal end of the dispenser that is furthest from a body portion of the dispenser;

a first reed valve operably attached to said first surface of said plug to close said first axial hole;

a second reed valve operably attached to said second surface of said plug to close said second axial hole;

a reed retainer operable to place a positive pressure onto said first reed valve with respect to said first axial hole; and a fastener attaching said first reed valve and said reed retainer to said first surface, said fastener extending through a first aperture formed in said first reed valve and a second aperture formed in said reed retainer.

13. The insert according to claim 12 wherein said reed retainer comprises aluminum, said first reed valve and said second reed valve comprise steel, and said plug comprises plastic.

14. The insert according to claim 12 wherein:

said first reed valve is operable to deflect away from said first surface when a positive pressure, originating proximate said second surface, is applied through said first axial hole; and said second reed valve is operable to deflect away from said second surface when a positive pressure, originating proximate said first surface, is applied through said second axial hole.

15. A method for dispensing a fluid from a flexible dispenser comprising:

applying a positive pressure to the dispenser to force the fluid through a first axial hole formed in a plug placed in an opening of the dispenser defined by a lip, the pressure causing a first reed valve mounted on a side of the plug opposite the fluid storage to move away from the first axial hole to allow the fluid to pass through, the positive pressure further causing a second reed valve on a side of the plug where the fluid is contained to maintain placement to substantially seal a second axial hole formed in the plug, wherein the plug includes a protrusion that engages the lip of the dispenser at a distal end of the dispenser that is furthest from a body portion of the dispenser;

utilizing a reed retainer to bias the first reed valve towards the first axial hole, wherein a fastener couples the first reed valve and the reed retainer to the plug, the fastener extending through a first aperture formed in the first reed valve and a second aperture formed in the reed retainer;

releasing the positive pressure to allow the first reed valve to return to a position that substantially seals the first axial hole and allows the second reed valve to open thereby allowing air to enter the dispenser through the second axial hole until a difference in pressure between an interior and an exterior of the dispenser is reduced to substantially zero; and allowing the second reed valve to substantially reseal the second axial hole.

* * * * *